US009818412B2

(12) United States Patent
Purnhagen et al.

(10) Patent No.: US 9,818,412 B2
(45) Date of Patent: Nov. 14, 2017

(54) METHODS FOR AUDIO ENCODING AND DECODING, CORRESPONDING COMPUTER-READABLE MEDIA AND CORRESPONDING AUDIO ENCODER AND DECODER

(71) Applicant: DOLBY INTERNATIONAL AB, Amsterdam (NL)

(72) Inventors: Heiko Purnhagen, Sundbyberg (SE); Lars Villemoes, Jarfalla (SE); Leif Jonas Samuelsson, Sundbyberg (SE); Toni Hirvonen, Stockholm (SE)

(73) Assignee: Dolby International AB, Amsterdam (NL)

( * ) Notice: Subject to any disclaimer, the term of this patent is extended or adjusted under 35 U.S.C. 154(b) by 0 days.

(21) Appl. No.: 14/890,793

(22) PCT Filed: May 23, 2014

(86) PCT No.: PCT/EP2014/060728

§ 371 (c)(1),
(2) Date: Nov. 12, 2015

(87) PCT Pub. No.: WO2014/187987

PCT Pub. Date: Nov. 27, 2014

(65) Prior Publication Data

US 2016/0111097 A1 Apr. 21, 2016

Related U.S. Application Data

(60) Provisional application No. 61/827,288, filed on May 24, 2013.

(51) Int. Cl.
*H04S 5/00* (2006.01)
*H04S 3/02* (2006.01)
(Continued)

(52) U.S. Cl.
CPC ..... *G10L 19/008* (2013.01); *G10L 19/20* (2013.01); *H04S 3/02* (2013.01); *H04S 5/00* (2013.01);
(Continued)

(58) Field of Classification Search
CPC ..... H04S 5/00; H04S 3/02; H04S 7/30; H04S 2400/03; H04S 2400/11; H04S 2420/03; H04S 2420/07; G10L 19/008; G10L 19/20
See application file for complete search history.

(56) References Cited

U.S. PATENT DOCUMENTS 7,394,903 B2 7/2008 Herre
7,751,572 B2 7/2010 Villemoes
(Continued)

FOREIGN PATENT DOCUMENTS

JP 2007-526522 9/2007
JP 2008-507184 3/2008
(Continued)

OTHER PUBLICATIONS

Chen, Der Pei, et al "Gram-Schmidt-Based Downmixer and Decorrelator in the MPEG Surround Coding" AES Convention Paper 8067, presented at the 128th Convention, May 22-25, 2010, London, UK.

(Continued)

*Primary Examiner* — Sonia Gay

(57) ABSTRACT

The present disclosure provides methods, devices and computer program products which provide less complex and more flexible control of the introduced decorrelation in an audio coding system. According to the disclosure, this is achieved by calculating and using two weighting factors, one for an approximated audio object and one for a decor-
(Continued)

related audio object, for introduction of decorrelation of audio objects in the audio coding system.

20 Claims, 4 Drawing Sheets

(51) Int. Cl.
*H04S 7/00* (2006.01)
*G10L 19/008* (2013.01)
*G10L 19/20* (2013.01)

(52) U.S. Cl.
CPC ..... *H04S 7/30* (2013.01); *H04S 2400/03* (2013.01); *H04S 2400/11* (2013.01); *H04S 2420/03* (2013.01); *H04S 2420/07* (2013.01)

(56) References Cited

U.S. PATENT DOCUMENTS

| | | | |
|---|---|---|---|
| 7,761,304 | B2 | 7/2010 | Faller |
| 7,787,631 | B2 | 8/2010 | Faller |
| 7,987,096 | B2 | 7/2011 | Kim |
| 8,296,158 | B2 | 10/2012 | Kim |
| 8,315,396 | B2 | 11/2012 | Schreiner |
| 8,340,306 | B2 | 12/2012 | Faller |
| 8,983,834 | B2 | 3/2015 | Davis |
| 2008/0097763 | A1 | 4/2008 | Van De Par et al. |
| 2008/0195398 | A1 | 8/2008 | Lee |
| 2010/0094631 | A1 | 4/2010 | Engdegard |
| 2012/0177204 | A1* | 7/2012 | Hellmuth ..... G10L 19/008 381/22 |
| 2012/0232910 | A1 | 9/2012 | Dressler |
| 2012/0259643 | A1 | 10/2012 | Engdegard |
| 2012/0269353 | A1 | 10/2012 | Herre |
| 2013/0016843 | A1 | 1/2013 | Herre |

FOREIGN PATENT DOCUMENTS

| | | |
|---|---|---|
| JP | 2008-516290 | 5/2008 |
| JP | 2009-508157 | 2/2009 |
| JP | 2011-527456 | 10/2011 |
| JP | 2012-530952 | 12/2012 |
| RS | 1332 U | 8/2013 |
| RU | 2406164 | 12/2010 |
| RU | 2452043 | 5/2012 |
| RU | 2461078 | 9/2012 |
| WO | 2008/035275 | 3/2008 |
| WO | 2008/039039 | 4/2008 |
| WO | 2008/069593 | 6/2008 |
| WO | 2010/149700 | 12/2010 |
| WO | 2011/086067 | 7/2011 |
| WO | 2012/125855 | 9/2012 |
| WO | 2013/066236 | 5/2013 |
| WO | 2014/187986 | 11/2014 |

OTHER PUBLICATIONS

Hotho, G. et al "A Backward-Compatible Multichannel Audio Codec" IEEE Transactions on Audio, Speech, and Language Processing, vol. 16, Issue 1, Jan. 1, 2008, pp. 83-93.
Herre, J. et al "New Concepts in Parametric Coding of Spatial Audio: From SAC to SAOC" IEEE International Conference on Multimedia and Expo, Jul. 2-5, 2007, pp. 1894-1897.
Ritz, C.H. et al "Backward Compatible Spatialized Teleconferencing Based on Squeezed Recordings" Advances in Sound Localization, published in Croatia, pp. 363-384, Apr. 2011.
Breebaart, J. et al "Binaural Rendering in MPEG Surround" Hindawi Publishing Corporation, EURASIP Journal on Advances in Signal Processing, 2008, 14 pages.
Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
Stanojevic, T. et al "Designing of TSS Halls" 13th International Congress on Acoustics, Yugoslavia, 1989.
Stanojevic, T. et al "The Total Surround Sound (TSS) Processor" SMPTE Journal, Nov. 1994.
Stanojevic, T. et al "The Total Surround Sound System", 86th AES Convention, Hamburg, Mar. 7-10, 1989.
Stanojevic, T. et al "TSS System and Live Performance Sound" 88th AES Convention, Montreux, Mar. 13-16, 1990.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav "3-D Sound in Future HDTV Projection Systems" presented at the 132nd SMPTE Technical Conference, Jacob K. Javits Convention Center, New York City, Oct. 13-17, 1990.
Stanojevic, Tomislav "Surround Sound for a New Generation of Theaters, Sound and Video Contractor" Dec. 20, 1995.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.
Engdegard, J. et al "Changes for Editorial Consistency of SAOC FCD Text", 91, MPEG Meeting Jan. 18-22, 2010, Motion Picture Expert Group or IS/IEC JTC1/SC29/WG11.
Purnhagen, H. et al "Synthetic Ambience in Parametric Stereo Coding" AES Coding Technologies, presented at the 116th Convention, May 8-11, 2004, Berlin, Germany.
ISO/IEC 23003-1:2007, Information Technology—MPEG Audio Technologies—Part 1:MPEG Surround, 2007.
ISO/IEC 14496-3:2005, Information Technology—Coding of Audio Visual Objects—Part 3: Audio, 2005.
MPEG SAOC (ISO/IEC 23003-2).
ISO/IEC FDIS 23003-2:2010 Information Technology—MPEG Audio Technologies—Part 2: Spatial Audio Object Coding (SAOC) ISO/IEC JTC 1/SC 29/WG 11, Mar. 10, 2010.

* cited by examiner

METHODS FOR AUDIO ENCODING AND DECODING, CORRESPONDING COMPUTER-READABLE MEDIA AND CORRESPONDING AUDIO ENCODER AND DECODER

CROSS-REFERENCE TO RELATED APPLICATIONS

This application claims priority from U.S. Provisional Patent Application No. 61/827,288 filed 24 May 2013 which is hereby incorporated by reference in its entirety.

TECHNICAL FIELD

The disclosure herein generally relates to audio coding. In particular it relates to using and calculating weighting factors for decorrelation of audio objects in an audio coding system.

The present disclosure is related to U.S. Provisional application No. 61/827,246 filed on the same date as the present application, entitled "Coding of Audio Scenes", and naming Heiko Purnhagen et al., as inventors. The referenced application is hereby included by reference in its entirety.

BACKGROUND ART

In conventional audio systems, a channel-based approach is employed. Each channel may for example represent the content of one speaker or one speaker array. Possible coding schemes for such systems include discrete multi-channel coding or parametric coding such as MPEG Surround.

More recently, a new approach has been developed. This approach is object-based. In systems employing the object-based approach, a three-dimensional audio scene is represented by audio objects with their associated positional metadata. These audio objects move around in the three-dimensional scene during playback of the audio signal. The system may further include so called bed channels, which may be described as stationary audio objects which are directly mapped to the speaker positions of for example a conventional audio system as described above. At a decoder side of such a system, the objects/bed channels may be reconstructed using downmix signals and an upmix or reconstruction matrix, wherein the objects/bed channels are reconstructed by forming linear combination of the downmix signals based on the value of the corresponding elements in the reconstruction matrix.

A problem that may arise in an object-based audio system, in particular at low target bit rates, is that the correlation between the decoded objects/bed channels can be larger than it was for the encoded original objects/bed channels. A common approach to solve such problems, and to improve the reconstruction of the audio objects, for example as in MPEG SAOC, is to introduce decorrelators in the decoder. In MPEG SAOC, the introduced decorrelation aims at reinstating a correct correlation between the audio objects given a specified rendering of the audio objects, i.e. depending on what type of playback unit that is connected to the audio system.

However, known methods for object-based audio systems are sensitive to the number of downmix signals and the number of objects/bed channels and may further be a complex operation which depends on the rendering of the audio objects. There is therefore a need for simple and flexible methods for controlling the amount of decorrelation introduced in the decoder in such systems, thereby allowing for improved reconstruction of audio objects.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1:
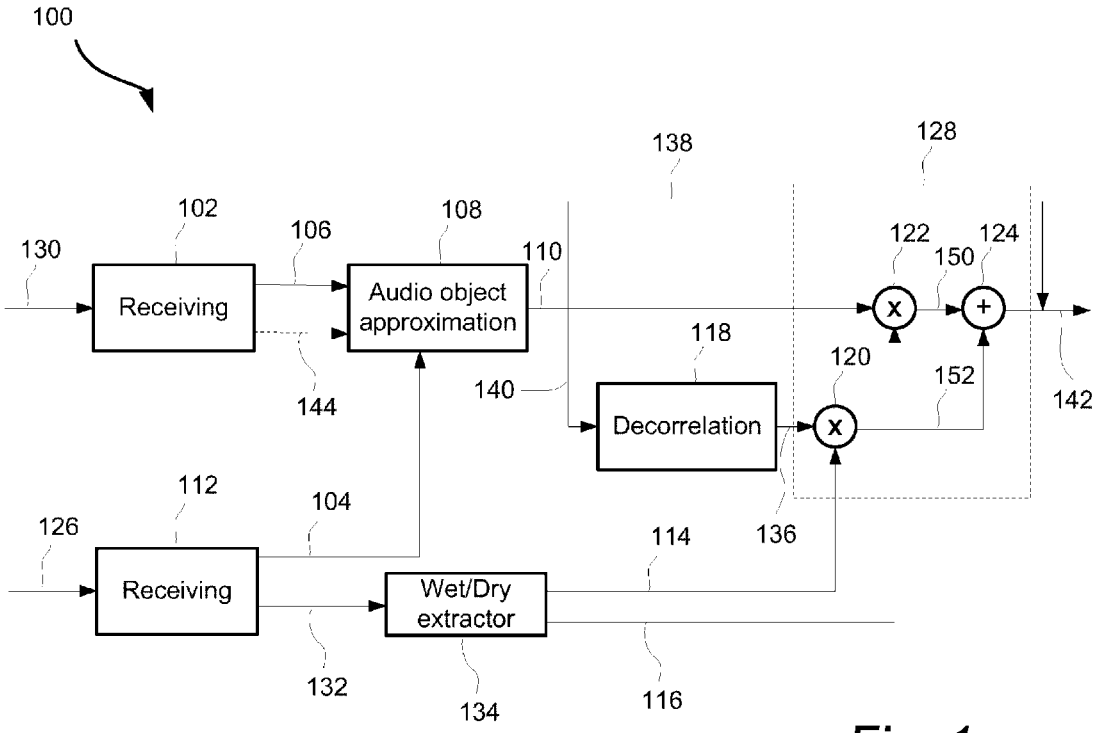
FIG. 1 is a generalized block diagram of an audio decoding system in accordance with an example embodiment.

In view of the above it is an object to provide an encoder and a decoder and associated methods which provide less complex and more flexible control of the introduced decorrelation, thereby allowing for improved reconstruction of audio objects.

I. Overview—Decoder

According to a first aspect, example embodiments propose decoding methods, decoders, and computer program products for decoding. The proposed methods, decoders and computer program products may generally have the same features and advantages.

According to example embodiments there is provided a method for reconstructing a time/frequency tile of N audio objects. The method comprises the steps of: receiving M downmix signals; receiving a reconstruction matrix enabling reconstruction of an approximation of the N audio objects from the M downmix signals; applying the reconstruction matrix to the M downmix signals in order to generate N approximated audio objects; subjecting at least a subset of the N approximated audio objects to a decorrelation process in order to generate at least one decorrelated audio object, whereby each of the at least one decorrelated audio object corresponds to one of the N approximated audio objects; for each of the N approximated audio objects not having a corresponding decorrelated audio object, reconstructing the time/frequency tile of the audio object by the approximated audio object; and for each of the N approximated audio objects having a corresponding decorrelated audio object, reconstructing the time/frequency tile of the audio object by: receiving at least one weighting parameter representing a first weighting factor and a second weighting factor, weighting the approximated audio object by the first weighting factor, weighting the decorrelated audio object corresponding to the approximated audio object by the second weighting factor, and combining the weighted approximated audio object with the corresponding weighted decorrelated audio object.

Audio encoding/decoding systems typically divide the time-frequency space into time/frequency tiles, e.g. by applying suitable filter banks to the input audio signals. By a time/frequency tile is generally meant a portion of the time-frequency space corresponding to a time interval and a frequency sub-band. The time interval may typically correspond to the duration of a time frame used in the audio encoding/decoding system. The frequency sub-band may typically correspond to one or several neighbouring frequency sub-bands defined by a filter bank used in the encoding/decoding system. In the case the frequency sub-band corresponds to several neighboring frequency sub-bands defined by the filter bank, this allows for having non-uniform frequency sub-bands in the decoding process of the audio signal, for example wider frequency sub-bands for higher frequencies of the audio signal. In a broadband case, where the audio encoding/decoding system operates on the whole frequency range, the frequency sub-band of the time/frequency tile may correspond to the whole frequency range. The above method discloses the steps for reconstructing such a time/frequency tile of N audio objects. However, it is to be understood that the method may be repeated for each time/frequency tile of the audio decoding system. Also it is to be understood that several time/frequency tiles may be encoded simultaneously. Typically, neighboring time/frequency tiles may overlap a bit in time and/or frequency. For example, an overlap in time may be equivalent to a linear interpolation of the elements of the reconstruction matrix in time, i.e. from one time interval to the next. However, this disclosure targets other parts of encoding/decoding system and any overlap in time and/or frequency between neighboring time/frequency tiles is left for the skilled person to implement.

As used herein, a downmix signal is a signal which is a combination of one or more bed channels and/or audio objects.

The above method provides a flexible and a simple method for reconstructing a time/frequency tile of N audio objects where any unwanted correlation between the approximated N audio objects is reduced. By using two weighting factors, one for the approximated audio object and one for the decorrelated audio object, a simple parameterization is achieved which allows for a flexible control of the amount of decorrelation being introduced.

Moreover, the simple parameterization in the method does not depend on what type of rendering the reconstructed audio objects are subjected to. An advantage of this is that the same method is used independently on what type of playback unit that is connected to the audio decoding system implementing the method, thus leading to a less complex audio decoding system.

According to an embodiment, for each of the N approximated audio objects having a corresponding decorrelated audio object, the at least one weighting parameter comprises a single weighting parameter from which the first weighting factor and the second weighting factor is derivable.

An advantage of this is that a simple parameterization to control the amount of decorrelation introduced in the audio decoding system is proposed. This approach uses a single parameter describing the mixture of "dry" (not decorrelated) and "wet" (decorrelated) contributions per object and time/frequency tile. By using a single parameter, the required bit rate may be reduced, compared to using several parameters, for example one describing the wet contribution and one describing dry contribution.

According to an embodiment, the square sum of the first weighting factor and the second weighting factor equals one. In this case, the single weighting parameter comprises either the first weighting factor or the second weighting factor. This may be a simple way of implementing a single weighting factor for describing the mixture of dry and wet contributions per object and time/frequency tile. Moreover, this means that the reconstructed object will have the same energy as the approximated object.

According to an embodiment, the step of subjecting at least a subset of the N approximated audio objects to a decorrelation process comprises subjecting each of the N approximated audio objects to a decorrelation process, whereby each of the N approximated audio objects corresponds to a decorrelated audio object. This may further reduce any unwanted correlation between the reconstructed audio objects since all reconstructed audio objects are based on both a decorrelated audio object and an approximated audio object.

According to an embodiment, the first and second weighting factors are time and frequency variant. Consequently, the flexibility of the audio decoding system may be increased in that different amount of decorrelation may be introduced for different time/frequency tiles. This may also further reduce any unwanted correlation between the reconstructed audio objects and improved the quality of the reconstructed audio objects.

According to an embodiment, the reconstruction matrix is time and frequency variant. Thereby, the flexibility of the audio decoding system is increased in that the parameters used to reconstruct or approximate the audio objects from the downmix signals may vary for different time/frequency tiles.

According to another embodiment, the reconstruction matrix and the at least one weighting parameter upon receipt are arranged in a frame. The reconstruction matrix is arranged in a first field of the frame using a first format and the at least one weighting parameter is arranged in a second field of the frame using a second format, thereby allowing a decoder that only supports the first format to decode the reconstruction matrix in the first field and discard the at least one weighting parameter in the second field. Thus, compatibility with a decoder which does not implement decorrelation may be achieved.

According to an embodiment, the method may further comprise receiving L auxiliary signals, wherein the reconstruction matrix further enables reconstruction of the approximation of the N audio objects from the M downmix signals and the L auxiliary signals, and wherein the method further comprises applying the reconstruction matrix to the M downmix signals and the L auxiliary signals in order to generate the N approximated audio objects. The L auxiliary signals may for example include at least one L auxiliary signal which is equal to one of the N audio objects to be reconstructed. This may increase the quality of the specific reconstructed audio object. This may be advantageous in the case where one of the N audio objects to be reconstructed represents a part of the audio signal which is of specific importance, for example an audio object representing the speaker voice in a documentary. According to an embodiment, at least one of the L auxiliary signals is a combination of at least two of the N audio objects to be reconstructed, thereby providing a compromise between bit rate and quality.

According to an embodiment, the M downmix signals span a hyperplane, and wherein at least one of the L auxiliary signals does not lie in the hyperplane spanned by the M downmix signals. Thereby, one or more of the L auxiliary signals may represent signal dimensions which are not included in any of the M downmix signals. Consequently, the quality of the reconstructed audio objects may increase. In an embodiment, at least one of the L auxiliary signals is orthogonal to the hyperplane spanned by the M downmix signals. Thus, the entire signal of the one or more of the L auxiliary signals represents parts of the audio signal not included in any of the M downmix signals. This may increase the quality of the reconstructed audio objects and at the same time reduce the required bit rate since the at least one of the L auxiliary signals does not include any information already present in any of the M downmix signals.

According to example embodiments there is provided a computer-readable medium comprising computer code instructions adapted to carry out any method of the first aspect when executed on a device having processing capability.

According to example embodiments there is provided an apparatus for reconstructing a time/frequency tile of N audio objects, comprising: a first receiving component configured to receive M downmix signals; a second receiving component configure to receive a reconstruction matrix enabling reconstruction of an approximation of the N audio objects from the M downmix signals; an audio object approximating component arranged downstreams of the first and second receiving components and configured to apply the reconstruction matrix to the M downmix signals in order to generate N approximated audio objects; a decorrelating component arranged downstreams of the audio object approximating component and configured to subject at least a subset of the N approximated audio objects to a decorrelation process in order to generate at least one decorrelated audio object, whereby each of the at least one decorrelated audio object corresponds to one of the N approximated audio objects; the second receiving component further configured to receive, for each of the N approximated audio objects having a corresponding decorrelated audio object, at least one weighting parameter representing a first weighting factor and a second weighting factor; and an audio object reconstructing component arranged downstreams of the audio object approximating component, the decorrelating component, and the second receiving component, and configured to: for each of the N approximated audio objects not having a corresponding decorrelated audio object, reconstruct the time/frequency tile of the audio object by the approximated audio object; and for each of the N approximated audio objects having a corresponding decorrelated audio object, reconstruct the time/frequency tile of the audio object by: weighting the approximated audio object by the first weighting factor; weighting the decorrelated audio object corresponding to the approximated audio object by the second weighting factor; and combining the weighted approximated audio object with the corresponding weighted decorrelated audio object.

II. Overview—Encoder

According to a second aspect, example embodiments propose encoding methods, encoders, and computer program products for encoding. The proposed methods, encoders and computer program products may generally have the same features and advantages.

According to example embodiments there is provided a method in an encoder for generating at least one weighting parameter, wherein the at least one weighting parameter is to be used in a decoder when reconstructing a time/frequency tile of a specific audio object by combining a weighted decoder side approximation of the specific audio object with a corresponding weighted decorrelated version of the decoder side approximated specific audio object, the method comprising the steps of: receiving M downmix signals being combinations of at least N audio objects including the specific audio object; receiving the specific audio object; calculating a first quantity indicative of an energy level of the specific audio object; calculating a second quantity indicative of an energy level corresponding to an energy level of an encoder side approximation of the specific audio object, the encoder side approximation being a combination of the M downmix signals; calculating the at least one weighting parameter based on the first and the second quantity.

The above method discloses the steps of generating at least one weighting parameter for a specific audio object during one time/frequency tile. However, it is to be understood that the method may be repeated for each time/frequency tile of the audio encoding/decoding system and for each audio object.

It may be noted that the tiling, i.e. dividing the audio signal/object into time/frequency tiles, in a audio encoding system does not have to be the same as the tiling in a audio decoding system.

It may also be noted that the decoder side approximation of the specific audio object and the encoder side approximation of the specific audio can be different approximations or they can be the same approximation.

In order to decrease the required bit rate and to reduce complexity, the at least one weighting parameter may comprise a single weighting parameter from which a first weighting factor and a second weighting factor is derivable, the first weighting factor for weighting of the decoder side approximation of the specific audio object and the second weighting factor for weighting the decorrelated version of the decoder side approximated audio object.

In order to prevent energy from being added to a reconstructed audio object on a decoder side, the reconstructed audio object comprising the decoder side approximation of the specific audio and the decorrelated version of the decoder side approximated audio object, the square sum of the first weighting factor and the second weighting factor may equal to one. In this case the single weighting parameter may comprise either the first weighting factor or the second weighting factor.

According to an embodiment, the step of calculating at least one weighting parameter comprises comparing the first quantity and the second quantity. For example, the energy of the approximated specific audio object and the energy of the specific audio object may be compared.

According to example embodiments, the comparing of the first quantity and the second quantity comprises calculating a ratio between the second and the first quantity, raising the ratio to a power of a and using the ratio raised to the power of a for calculating the weighting parameter. This may increase the flexibility of the encoder. The parameter a may be equal to two.

According to example embodiments, the ratio raised to the power of a is subjected to an increasing function which maps the ratio raised to the power of a to the at least one weighting parameter.

According to example embodiments, the first and second weighting factors are time and frequency variant.

According to example embodiments, the second quantity indicative of an energy level corresponds to an energy level of an encoder side approximation of the specific audio object, the encoder side approximation being a linear combination of the M downmix signals and L auxiliary signals, the downmix signals and the auxiliary signals being formed from the N audio objects. In order to improve the reconstruction of the audio object on a decoder side, auxiliary signals may be included in the audio encoding/decoding system.

According to an exemplary embodiment, at least one of the L auxiliary signals may correspond to particularly important audio objects, such as an audio object representing dialogue. Thus at least one of the L auxiliary signals may be equal to one of the N audio objects. According to further embodiments, at least one of the L auxiliary signals is a combination of at least two of the N audio objects.

According to embodiments, the M downmix signals span a hyperplane, and wherein at least one of the L auxiliary signals does not lie in the hyperplane spanned by the M downmix signals. This means that at least one of the L auxiliary signals represent signal dimensions of the audio objects that got lost in the process of generating the M downmix signals, which may improve the reconstruction of the audio object on a decoder side. According to further embodiments, the at least one of the L auxiliary signals is orthogonal to the hyperplane spanned by the M downmix signals.

According to example embodiments there is provided a computer-readable medium comprising computer code instructions adapted to carry out any method of the second aspect when executed on a device having processing capability.

According to an embodiment there is provided an encoder for generating at least one weighting parameter, wherein the at least one weighting parameter is to be used in a decoder when reconstructing a time/frequency tile of a specific audio object by combining a weighted decoder side approximation of the specific audio object with a corresponding weighted decorrelated version of the decoder side approximated specific audio object, the apparatus comprising: a receiving component configured to receive M downmix signals being combinations of at least N audio objects including the specific audio object, the receiving component further configured to receive the specific audio object; a calculating unit configured to: calculate a first quantity indicative of an energy level of the specific audio object; calculate a second quantity indicative of an energy level corresponding to an energy level of an encoder side approximation of the specific audio object, the encoder side approximation being a combination of the M downmix signals; calculating the at least one weighting parameter based on the first and the second quantity.

Example Embodiments

FIG. 1 shows a generalized block diagram of an audio decoding system 100 for reconstructing N audio objects. The audio decoding system 100 performs time/frequency resolved processing, meaning that it operates on individual time/frequency tiles to reconstruct the N audio objects. In the following, the processing of the system 100 for reconstructing one time/frequency tile of the N audio objects will be described. The N audio objects may be one or more audio objects.

The system 100 comprises a first receiving component 102 configured to receive M downmix signals 106. The M downmix signals may be one or more downmix signals. The M downmix signals 106 may for example be a 5.1 or 7.1 surround signal which is backwards compatible with established sound decoding systems such as Dolby Digital Plus, MPEG or AAC. In other embodiments, the M downmix signals 106 are not backwards compatible. The input signal to the first receiving component 102 may be a bit stream 130 from which the receiving component can extract the M downmix signals 106.

The system 100 further comprises a second receiving component 112 configured to receive a reconstruction matrix 104 enabling reconstruction of an approximation of the N audio objects from the M downmix signals 106. The reconstruction matrix 104 may also be called an upmix matrix. The input signal 126 to the second receiving component 112 may be a bit stream 126 from which the receiving component can extract the reconstruction matrix 104 or elements thereof and additional information which will be explained in detail below. In some embodiments of the audio decoding system 100, the first receiving component 102 and the second receiving component 112 are combined in one single receiving component. In some embodiments, the input signals 130, 126 are combined to one single input signal which may be a bit stream with a format allowing the receiving components 102, 112 to extract the different information from the one single input signal.

The system 100 may further comprise an audio object approximating component 108 arranged downstreams of the first 102 and second 112 receiving components and configured to apply the reconstruction matrix 104 to the M downmix signals 106 in order to generate N approximated audio objects 110. More specifically, the audio object approximating component 108 may perform a matrix operation in which the reconstruction matrix 104 is multiplied by a vector comprising the M downmix signals. The reconstruction matrix 104 may be time and frequency variant, i.e. the value of the elements in the reconstruction matrix 104 may differ for each time/frequency tile. Thus, the elements of the reconstruction matrix 104 depend on which time/frequency tile is currently processed.

An approximated $\hat{S}_n(k,l)$ audio object n at frequency k and time slot l, i.e. a time/frequency tile, is for example computed at the audio object approximating component 108, for example by $\hat{S}_n(k,l)=\Sigma_{m=1}^{M} c_{m,b,n} Y_m(k,l)$ for all frequency samples k in frequency band b, b=1, . . . , B, where $c_{m,b,n}$ is the reconstruction coefficient of object n in frequency band b and associated with downmix channel $Y_m$. It may be noted that the reconstruction coefficient $C_{m,b,n}$ is assumed to be fixed over the time/frequency tile, but in further embodiments, the coefficient may vary during the time/frequency tile.

The system 100 further comprises a decorrelating component 118 arranged downstreams of the audio object approximating component 108. The decorrelating component 118 is configured to subject at least a subset 140 of the N approximated audio objects 110 to a decorrelation process in order to generate at least one decorrelated audio object 136. In other words may all or just some of the N approximated audio objects 110 be subject to a decorrelation process. Each of the at least one decorrelated audio object 136 corresponds to one of the N approximated audio objects 110. More precisely, the set of decorrelated audio objects 136 corresponds to the set 140 of approximated audio objects which is input to the decorrelation process 118. The purpose of the at least one decorrelated audio object 136 is to reduce unwanted correlation between the N approximated audio objects 110. This unwanted correlation may appear in particular at low target bit rates of an audio system comprising the audio decoding system 100. At low target bit rates, the reconstruction matrix may be sparse. This means that many of the elements in the reconstruction matrix may be zero. In this case, a particular approximated audio object 110 may be based on a single downmix signal or a few downmix signals from the M downmix signals 106, thus increasing the risk of introducing unwanted correlation between the approximated audio objects 110. According to some embodiments, each of the N approximated audio objects 110 are subjected to a decorrelation process by the decorrelating component 118, whereby each of the N approximated audio objects 110 corresponds to a decorrelated audio object 136.

Each of the N approximated audio objects 110 subjected to the decorrelation process by the decorrelating component 118 may be subjected to a different decorrelation process, for example by applying a white noise filter to the approximated audio object being decorrelated or by applying any other suitable decorrelation process, such as all-pass filtering Examples of further decorrelation processes can be found in the MPEG Parametric Stereo coding tool (used in HE-AAC v2, as described in ISO/IEC 14496-3 and in the paper: J. Engdegård, H. Purnhagen, J. Rödén, L. Liljeryd, "Synthetic ambience in parametric stereo coding," in AES 116th Convention, Berlin, Del., May 2004.), MPEG Surround (ISO/IEC 23003-1), and MPEG SAOC (ISO/IEC 23003-2).

To not introduce unwanted correlation, the different decorrelation processes are mutually decorrelated. According to other embodiments, several or all of the approximated audio objects 110 are subjected to the same decorrelation process.

The system 100 further comprises an audio object reconstructing component 128. The object reconstructing component 128 is arranged downstreams of the audio object approximating component 108, the decorrelating component 118, and the second receiving component 112. The object reconstructing component 128 is configured to, for each of the N approximated audio objects 138 not having a corresponding decorrelated audio object 136, reconstruct the time/frequency tile of the audio object 142 by the approximated audio object 138. In other words, if a certain approximated audio object 138 has not been subject to a decorrelation process, it is simply reconstructed as the approximated audio object 110 provided by the audio object approximating component 108. The object reconstructing component 128 is further configured to, for each of the N approximated audio objects 110 having a corresponding decorrelated audio object 136, reconstruct the time/frequency tile of the audio object using both the decorrelated audio object 136 and the corresponding approximated audio object 110.

To facilitate this process, the second receiving component 112 is further configured to receive, for each of the N approximated audio objects 110 having a corresponding decorrelated audio object 136, at least one weighting parameter 132. The at least one weighting parameter 132 represents a first weighting factor 116 and a second weighting factor 114. The first weighting factor 116, also called a dry factor, and the second weighting factor 114, also called a wet factor, is derived by a wet/dry extractor 134 from the at least one weighting parameter 132. The first and/or the second weighting factors 116, 114 may be time and frequency variant, i.e. the value of the weighting factors 116, 114 may differ for each time/frequency tile being processed.

In some embodiments the at least one weighting parameter 132 comprises the first weighting factor 116 and the second weighting factor 114. In some embodiments the at least one weighting parameter 132 comprises a single weighting parameter. If so, the wet/dry extractor 134 may derive the first and the second weighting factor 116, 114 from the single weighting parameter 132. For example, the first and the second weighting factor 116, 114 may fulfil certain relations which allow the one of the weighting factors to be derived once the other weighting factor is known. An example or such a relation may be that the square sum of the first weighting factor 116 and the second weighting factor 114 is equal to one. Thus, if the single weighting parameter 132 comprises the first weighting factor 116 the second weighting factor 114 may be derived as the square root of one minus the squared first weighting factor 116, and vice versa.

The first weighting factor 116 is used for weighting 122, i.e. for multiplication with, the approximated audio object 110. The second weighting factor 114 is used for weighting 120, i.e. for multiplication with, the corresponding decorrelated audio object 136. The audio object reconstructing component 128 is further configured to combine 124, e.g. by performing a summation, the weighted approximated audio object 150 with the corresponding weighted decorrelated audio object 152 to reconstruct the time/frequency tile of the corresponding audio object 142.

In other words, for each object and each time/frequency tile, the amount of decorrelation may be controlled by one weighting parameter 132. In the wet/dry extractor 134, this weighting parameter 132 is converted into a weight factor 116 ($w_{dry}$) applied to the approximated object 110, and a weight factor 114 ($w_{wet}$) applied to the decorrelated object 136. The square sum of these weight factors is one, i.e.

$$w_{wet}^2+w_{dry}^2=1,$$

which means that the final object 142, which is output of the summation 124 has the same energy as the corresponding approximated object 110.

Figure 2:
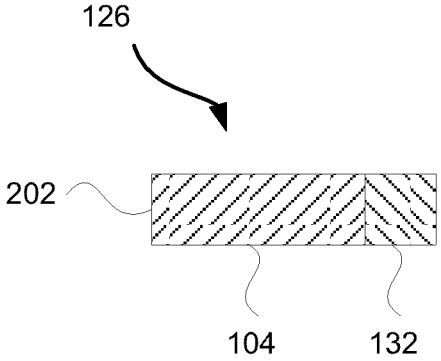
FIG. 2 shows by way of example a format in which a reconstruction matrix and a weighting parameter is received by the audio decoding system of FIG. 1.

In order to allow the input signals 126, 130 to be decoded by an audio decoder system which is not able to handle decorrelation, i.e. to preserve backwards compatibility with such an audio decoder, the input signal 126 may be arranged in a frame 202, as depicted in FIG. 2. According to this embodiment, the reconstruction matrix 104 is arranged in a first field of the frame 202 using a first format and the at least one weighting parameter 132 is arranged in a second field of the frame 202 using a second format. In this way, a decoder which is able to read the first format but not the second format, may still decode and use the reconstruction matrix 104 for upmixing the downmix signal 106 in any conventional way. The second field of the frame 202 may in this case be discarded.

According to some embodiments, the audio decoding system 100 in FIG. 1 may additionally receive L auxiliary signals 144, for example at the first receiving component 102. There may be one or more such auxiliary signals, i.e. $L \geq 1$. These auxiliary signals 144 may be included in the input signal 130. The auxiliary signals 144 may be included in the input signal 130 in such a way that backwards compatibility according to above is maintained, i.e. such that a decoder system not able to handle auxiliary signals still can derive the downmix signals 106 from the input signal 130. The reconstruction matrix 104 may further enable reconstruction of the approximation of the N audio objects 110 from the M downmix signals 106 and the L auxiliary signals 144. The audio object approximating component 108 may thus be configured to applying the reconstruction matrix 104 to the M downmix signals 106 and the L auxiliary signals 144 in order to generate the N approximated audio objects 110.

The role of the auxiliary signals 144 is to improve the approximation of the N audio objects in the audio object approximation component 108. According to one example, at least one of the auxiliary signals 144 is equal to one of the N audio objects to be reconstructed. In that case, the vector in the reconstruction matrix 104 used to reconstruct the specific audio object will only contain a single non-zero parameter, e.g. a parameter with the value one (1). According to other examples, at least one of the L auxiliary signals 144 is a combination of at least two of the N audio objects to be reconstructed.

In some embodiments, the L auxiliary signals may represent signal dimensions of the N audio objects which were lost information in the process of generating the M downmix signals 106 from the N audio objects. This can be explained by saying that the M downmix signals 106 span a hyperplane in a signal space, and that the L auxiliary signals 144 does not lie in this hyperplane. For example, the L auxiliary signals 144 may be orthogonal to the hyperplane spanned by the M downmix signals 106. Based on the M downmix signals 106 alone, only signals which lie in the hyperplane may be reconstructed, i.e. audio objects which do not lie in the hyperplane will be approximated by an audio signal in the hyperplane. By further using the L auxiliary signals 144 in the reconstruction, also signals which do not lie in the hyperplane may be reconstructed. As a result, the approximation of the audio objects may be improved by also using the L auxiliary signals.

Figure 3:
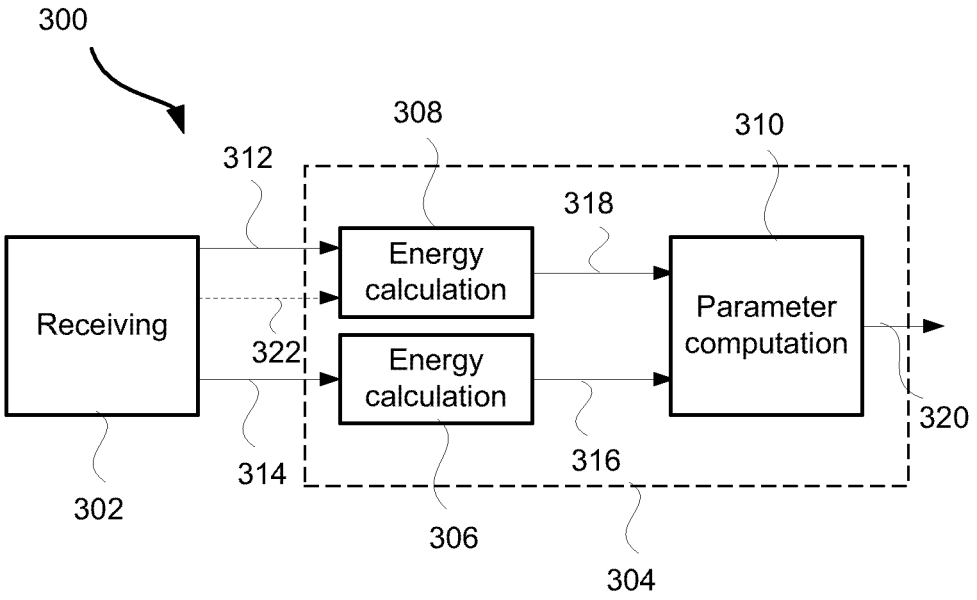
FIG. 3 is a generalized block diagram of an audio encoder for generating at least one weighting parameter to be used in a decorrelation process in an audio decoding system.

FIG. 3 shows by way of example a generalized block diagram of an audio encoder 300 for generating at least one weighting parameter 320. The at least one weighting parameter 320 is to be used in a decoder, for example the audio decoding system 100 described above, when reconstructing a time/frequency tile of a specific audio object by combining (reference 124 of FIG. 1) a weighted decoder side approximation (reference 150 of FIG. 1) of the specific audio object with a corresponding weighted decorrelated version (reference 152 of FIG. 1) of the decoder side approximated specific audio object.

The encoder 300 comprises a receiving component 302 configured to receive configured to receive M downmix signals 312 being combinations of at least N audio objects including the specific audio object. The receiving component 302 is further configured to receive the specific audio object 314. In some embodiments, the receiving component 302 is further configured to receive L auxiliary signals 322. As discussed above, at least one of the L auxiliary signals 322 may equal to one of the N audio objects, at least one of the L auxiliary signals 322 may be a combination of at least two of the N audio objects, and at least one of the L auxiliary signals 322 may contain information not present in any of the M downmix signals.

The encoder 300 further comprises a calculation unit 304. The calculation unit 304 is configured to calculate to a first quantity 316 indicative of an energy level of the specific audio object, for example at a first energy calculation component 306. The first quantity 316 may be calculated as a norm of the specific audio object. For example the first quantity 316 may be equal to the energy of the specific audio object and may thus be calculated by the two-norm $Q_1=\|S\|^2$, where S denotes the specific audio object. The first quantity may alternatively be calculated as another quantity which is indicative of the energy of the specific audio object, such as the square root of the energy.

The calculation unit 304 is further configured to calculate a second quantity 318 which is indicative of an energy level corresponding to an energy level of an encoder side approximation of the specific audio object 314. The encoder side approximation may for example be a combination, such as a linear combination, of the M downmix signals 312. Alternatively, the encoder side approximation may be a combination, such as a linear combination, of the M downmix signals 312 and the L auxiliary signal 322. The second quantity may be calculated at a second energy calculation component 308.

Then encoder side approximation may for example be computed by using a non-energy matched upmix matrix and the M downmix signal 312. By the term "non-energy matched" should, in the context of present specification, be understood that the approximation of the specific audio object will not be energy matched to the specific audio object itself, i.e. the approximation will have a different energy level, often lower, compared to the specific audio object 314.

The non-energy matched upmix matrix may be generated using different approaches. For example, a Minimum Mean Squared Error (MMSE) predictive approach can be used which takes at least the N audio objects as well as the M downmix signals 312 (and possibly the L auxiliary signals 322) as input. This can be described as an iterative approach which aims at finding the upmix matrix that minimizes the mean squared error of approximations of the N audio objects. Particularly, the approach approximates the N audio objects with a candidate upmix matrix, which is multiplied with the M downmix signals 312 (and possibly the L auxiliary signals 322), and compares the approximations with the N audio objects in terms of the mean squared error. The candidate upmix matrix that minimizes the mean squared error is selected as the upmix matrix which is used to define the encoder side approximation of the specific audio object.

When the MMSE approach is used, the prediction error e between the specific audio object S and the approximated audio object S' is orthogonal toS. This means that:

$$\|S'\|^2+\|e\|^2=\|S\|^2.$$

In other words, the energy of the audio object S is equal to the sum of the energy of approximated audio object and the energy of the prediction error. Due to the above relation, the energy of the prediction error e thus gives an indication of the energy of the encoder side approximation S'.

Consequently, the second quantity 318 may be calculated using either the approximation of the specific audio object S' or the prediction error. The second quantity may be calculated as a norm of the approximation of the specific audio object S' or a norm of the prediction error e. For example, the second quantity may be calculated as the 2-norm, i.e. $Q_2=\|S'\|^2$ or $Q_2=\|e\|^2$. The second quantity may alternatively be calculated as another quantity which is indicative of the energy of the approximated specific audio object, such as the square root of the energy of the approximated specific audio object or the square root of the energy of the prediction error.

The calculating unit is further configured for calculating the at least one weighting parameter 320 based on the first 316 and the second 318 quantity, for example at a parameter computation component 310. The parameter computation component 310 may for example calculating the at least one weighting parameter 320 by comparing the first quantity 316 and the second quantity 318. An exemplary parameter computation component 310 will now be explained in detail in conjunction with FIG. 4 and FIGS. 5*a-c*.

Figure 4:
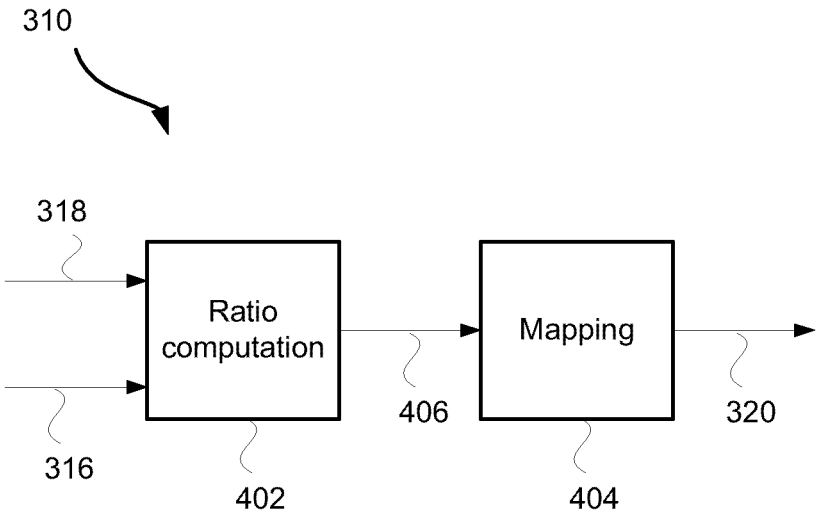
FIG. 4 shows by way of example a generalized block diagram of a part of the encoder of FIG. 3 for generating the at least one weighting parameter.
Figure 5A:
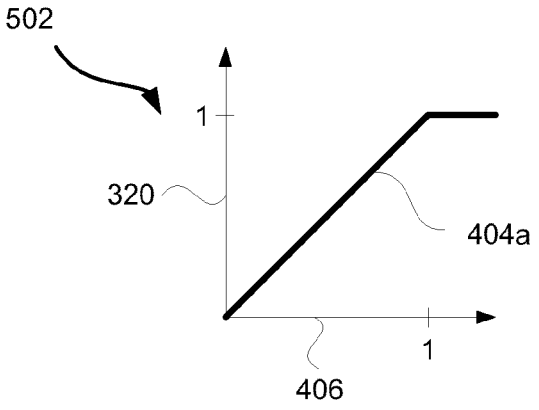
FIGS. 5*a*-5*c* shows by way of example mapping functions used in the part of the encoder of FIG. 4.
Figure 5B:
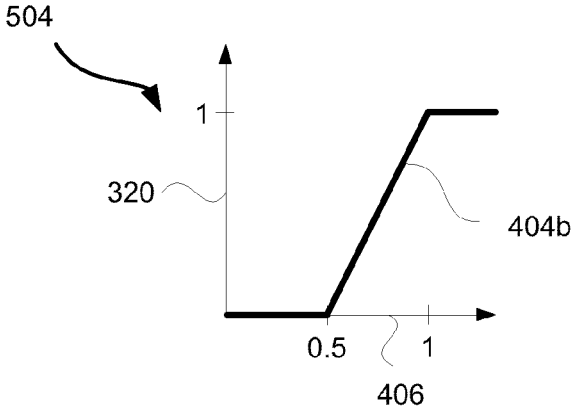
Figure 5C:
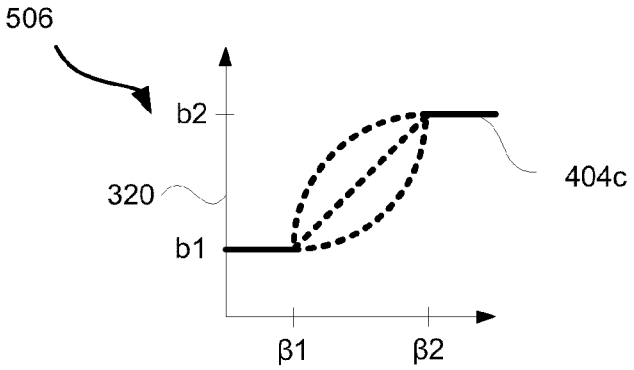

FIG. 4 shows by way of example a generalized block diagram of the parameter computation component 310 for generating the at least one weighting parameter 320. The parameter computation component 310 compares the first quantity 316 and the second quantity 318, for example at a ratio computation component 402, by calculating a ratio r between the second 318 and the first 316 quantity. The ratio is then raised to a power of $\alpha$, i.e.

$$r = \left(\frac{Q_2}{Q_1}\right)^{\alpha}$$

where $Q_2$ is the second quantity 318 and $Q_1$ is the first quantity 316. According to some embodiments, when $Q_2=\|S'\|$ and $Q_1=\|S\|$, $\alpha$ is equal to 2, i.e. the ratio r is a ratio of the energies of the approximated specific audio object and the specific audio object. The ratio raised to the power of $\alpha$ 406 is then used for calculating the at least one weighting parameter 320, for example at a mapping component 404. The mapping component 404 subjects r 406 to an increasing function which maps r to the at least one weighting parameter 320. Such increasing functions are exemplified in FIGS. 5*a-c*. In FIGS. 5*a-c*, the horizontal axis represents the value of r 406 and the vertical axis represents the value of the weighting parameter 320. In this example, the weighting parameter 320 is a single weighting parameter which corresponds to the first weighting factor 116 in FIG. 1.

In general, the principle for the mapping function is:

If $Q_2 \ll Q_1$, the first weighting factor approaches 0, and if $Q_2 \approx Q_1$, the first weighting factor approaches 1.

FIG. 5*a* shows a mapping function 502 in which, for values of r 406 between 0 and 1, the value of r will be the same as the value of the weighting parameter 312. For values of r above 1, the value of the weighting parameter 320 will be 1.

FIG. 5*b* shows another mapping function 504 in which, for values of r 406 between 0 and 0.5, the value of the weighting parameter 320 will be 0. For values of r above 1, the value of the weighting parameter 320 will be 1. For values of r between 0.5 and 1, the value of the weighting parameter 320 will be (r−0.5)*2.

FIG. 5*c* shows a third alternative mapping function 506 which generalizes the mapping functions of FIGS. 5*a-b*. The mapping function 506 is defined by at least four parameters, $b_1$, $b_2$, $\beta_1$ and $\beta_2$, which may be constants tuned for best perceptual quality of the reconstructed audio objects on a decoder side. In general, limiting the maximum amount of decorrelation in the output audio signal may be beneficial since a decorrelated approximated audio object often is of poorer quality than an approximated audio object when listened to separately. Setting $b_1$ to be larger than zero controls this directly and may thus ensure that the weighting parameter 320 (and thus the first weighting factor 116 in FIG. 1) will be larger than zero in all cases. Setting $b_2$ to be less than 1 has the effect that there is always a minimum level of decorrelation energy in the output from the audio decoding system 100. In other words, the second weighting factor 114 in FIG. 1 will always be larger than zero. $\beta_1$ implicitly controls the amount of decorrelation added in the output from the audio decoding system 100 but with different dynamics involved (compared to $b_1$). Similarly $\beta_2$ implicitly controls the amount of decorrelation in the output from the audio decoding system 100.

In the case a curved mapping function between the values $\beta_1$ and $\beta_2$ of r is desired, at least one further parameter is needed which may be a constant.

Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A method for reconstructing a time/frequency tile of N audio objects, comprising the steps of:

receiving M downmix signals;

receiving a reconstruction matrix enabling reconstruction of an approximation of the N audio objects from the M downmix signals;

applying the reconstruction matrix to the M downmix signals in order to generate N approximated audio objects;

subjecting at least a subset of the N approximated audio objects to a decorrelation process in order to generate at least one decorrelated audio object, whereby each of the at least one decorrelated audio object corresponds to one of the N approximated audio objects;

for each of the N approximated audio objects not having a corresponding decorrelated audio object, reconstructing a time/frequency tile of the audio object by the approximated audio object; and for each of the N approximated audio objects having a corresponding decorrelated audio object, reconstructing the time/frequency tile of the audio object by:

receiving a single weighting parameter from which a first weighting factor and a second weighting factor are derivable, weighting the approximated audio object by the first weighting factor, weighting the decorrelated audio object corresponding to the approximated audio object by the second weighting factor, and combining, by performing a summation, the weighted approximated audio object with the corresponding weighted decorrelated audio object for reconstructing the time/frequency tile of the approximated audio object, whereby an energy level of the reconstructed time/frequency tile equals an energy level of a corresponding time/frequency tile of the approximated audio object.

2. The method of claim 1, wherein a square sum of the first weighting factor and the second weighting factor equals one, and wherein the single weighting parameter comprises either the first weighting factor or the second weighting factor.

3. The method of claim 1, wherein the step of subjecting at least a subset of the N approximated audio objects to a decorrelation process comprises subjecting each of the N approximated audio objects to a decorrelation process, whereby each of the N approximated audio objects corresponds to a decorrelated audio object.

4. The method of claim 1, wherein the first and second weighting factors are time and frequency variant.

5. The method of claim 1, wherein the reconstruction matrix is time and frequency variant.

6. The method of claim 1, wherein the reconstruction matrix and the at least one weighting parameter upon receipt are arranged in a frame, wherein the reconstruction matrix is arranged in a first field of the frame using a first format and the at least one weighting parameter is arranged in a second field of the frame using a second format, thereby allowing a decoder that only supports the first format to decode the reconstruction matrix in the first field and discard the at least one weighting parameter in the second field.

7. The method of claim 1, further comprising receiving L auxiliary signals, wherein the reconstruction matrix further enables reconstruction of the approximation of the N audio objects from the M downmix signals and the L auxiliary signals, and wherein the method further comprises applying the reconstruction matrix to the M downmix signals and the L auxiliary signals in order to generate the N approximated audio objects.

8. The method of claim 7, wherein at least one of the L auxiliary signals is equal to one of the N audio objects to be reconstructed, is a combination of at least two of the N audio objects to be reconstructed, or does not lie in a hyperplane spanned by the M downmix signals.

9. The method of claim 8, wherein the at least one of the L auxiliary signals is orthogonal to the hyperplane spanned by the M downmix signals.

10. A non-transitory computer-readable medium with instructions stored thereon that when executed by one or more processor for performing the method of claim 1 when executed on a device having processing capability.

11. An apparatus for reconstructing a time/frequency tile of N audio objects, comprising:

a first receiver for receiving M downmix signals ;

a second receiver for receiving a reconstruction matrix enabling reconstruction of an approximation of the N audio objects from the M downmix signals;

an audio object approximator arranged downstream of the first and second receiving components and for applying the reconstruction matrix to the M downmix signals in order to generate N approximated audio objects;

a decorrelator arranged downstream of the audio object approximator and to subject at least a subset of the N approximated audio objects to a decorrelation process in order to generate at least one decorrelated audio object, whereby each of the at least one decorrelated audio object corresponds to one of the N approximated audio objects;

the second receiver for receiving, for each of the N approximated audio objects having a corresponding decorrelated audio object, a single weighting parameter from which a first weighting factor and a second weighting factor are derivable; and an audio object constructor arranged downstreams of the audio object approximator, the decorrelator, and the second receiver, wherein each of the N approximated audio objects not having a corresponding decorrelated audio object, reconstructing the time/frequency tile of the audio object by the approximated audio object; and for each of the N approximated audio objects having a corresponding decorrelated audio object, reconstruct the time/frequency tile of the audio object by:

weighting the approximated audio object by the first weighting factor;

weighting the decorrelated audio object corresponding to the approximated audio object by the second weighting factor; and combining, by performing a summation, the weighted approximated audio object with the corresponding weighted decorrelated audio object for reconstructing the time/frequency tile of the approximated audio object, whereby an energy level of the reconstructed time/frequency tile equals an energy level of a corresponding time/frequency tile of the approximated audio object.

12. A method in an encoder for generating at least one weighting parameter, to be used when reconstructing a time/frequency tile of a specific audio object the method comprising the steps of:

receiving M downmix signals being combinations of at least N audio objects including the specific audio object;

receiving the specific audio object;

calculating a first quantity indicative of an energy level of the specific audio object;

calculating a second quantity indicative of an energy level corresponding to an energy level of an encoder side approximation of the specific audio object, the encoder side approximation being a combination of the M downmix signals;

calculating at least one weighting parameter based on the first and the second quantity, wherein the at least one weighting parameter is used for weighting a decoder side approximation of the specific audio object and a decorrelated version of the decoder side approximation of the specific audio object, wherein the method is implemented by one or more processors and memory.

13. The method according to 12, wherein the at least one weighting parameter comprises a single weighting parameter from which a first weighting factor and a second weighting factor is derivable, the first weighting factor for weighting of the decoder side approximation of the specific audio object and the second weighting factor for weighting the decorrelated version of the decoder side approximated audio object.

14. The method of claim 12, wherein the step of calculating at least one weighting parameter comprises comparing the first quantity and the second quantity.

15. The method of claim 12, wherein the comparing the first quantity and the second quantity comprises calculating a ratio between the second and the first quantity, raising the ratio to a power of $\alpha$ and using the ratio raised to the power of $\alpha$ for calculating the weighting parameter.

16. The method of claim 15, wherein $\alpha$ is equal to two.

17. The method of claim 15, wherein the ratio raised to the power of $\alpha$ is subjected to an increasing function which maps the ratio raised to the power of $\alpha$ to the at least one weighting parameter.

18. The method according to claim 12, wherein the second quantity indicative of an energy level corresponds to an energy level of an encoder side approximation of the specific audio object, the encoder side approximation being a linear combination of the M downmix signals and L auxiliary signals, the downmix signals and the auxiliary signals being formed from the N audio objects.

19. A non-transitory computer-readable medium with instructions stored thereon that when executed by one or more processor for performing the method of claim 12 when executed on a device having processing capability.

20. An encoder, implemented by one or more processors and memory, for generating at least one weighting parameter to be used when reconstructing a time/frequency tile of a specific audio object the apparatus comprising:

a receiver for receiving M downmix signals being combinations of at least N audio objects including the specific audio object, the receiving component further receiving the specific audio object;

a calculator for:

calculating a first quantity indicative of an energy level of the specific audio object;

calculating a second quantity indicative of an energy level corresponding to an energy level of an encoder side approximation of the specific audio object, the encoder side approximation being a combination of the M downmix signals; and calculating the at least one weighting parameter based on the first and the second quantity, wherein the at least one weighting parameter is used for weighting a decoder side approximation of the specific audio object and a decorrelated version of the decoder side approximation of the specific audio object.

* * * * *